US006057010A

United States Patent [19]

Ayers

[11] Patent Number: 6,057,010

[45] Date of Patent: May 2, 2000

[54] SPACE SAVING SPLIT TREE

[76] Inventor: Robert M. Ayers, 48-18 212th St., Bayside, N.Y. 11364

[21] Appl. No.: 09/174,356

[22] Filed: Oct. 15, 1998

[51] Int. Cl.[7] ..... A47G 33/06

[52] U.S. Cl. ..... 428/18; 428/20

[58] Field of Search ..... 428/8, 18, 20

[56] References Cited

U.S. PATENT DOCUMENTS 638,895 12/1899 Wallis ..... 428/18 X
3,101,291 8/1963 Lalick ..... 428/18 X
3,214,318 10/1965 Snow ..... 428/8
3,296,430 1/1967 Eckert ..... 428/20 X
4,774,113 9/1988 Shaffer ..... 428/18
5,054,622 10/1991 Lee ..... 428/18 X

*Primary Examiner*—Henry F. Epstein

[57] ABSTRACT

A space saving decorative tree is provided including a base and a plurality of posts interconnected with respect to each other and further connected to the base and extending upwardly therefrom. Next provided is a plurality of branches removably coupled to the posts, wherein the branches are constrained by an arc of no more than 180 degrees.

9 Claims, 2 Drawing Sheets

SPACE SAVING SPLIT TREE

BACKGROUND OF THE INVENTION

1. Field of the Invention

The present invention relates to artificial Christmas trees and more particularly pertains to a new space saving split tree for saving space against a wall or in a corner.

2. Description of the Prior Art

The use of artificial Christmas trees is known in the prior art. More specifically, artificial Christmas trees heretofore devised and utilized are known to consist basically of familiar, expected and obvious structural configurations, notwithstanding the myriad of designs encompassed by the crowded prior art which have been developed for the fulfillment of countless objectives and requirements.

Known prior art artificial Christmas trees include U.S. Pat. Nos. 5,409,745; 5,054,622; 4,897,292; 5,401,545; 4,967,508; and U.S. Pat. Des. 351,810.

In these respects, the space saving split tree according to the present invention substantially departs from the conventional concepts and designs of the prior art, and in so doing provides an apparatus primarily developed for the purpose of saving space against a wall or in a corner.

SUMMARY OF THE INVENTION

In view of the foregoing disadvantages inherent in the known types of artificial Christmas trees now present in the prior art, the present invention provides a new space saving split tree construction wherein the same can be utilized for saving space against a wall or in a corner.

The general purpose of the present invention, which will be described subsequently in greater detail, is to provide a new space saving split tree apparatus and method which has many of the advantages of the artificial Christmas trees mentioned heretofore and many novel features that result in a new space saving split tree which is not anticipated, rendered obvious, suggested, or even implied by any of the prior art artificial Christmas trees, either alone or in any combination thereof.

To attain this, the present invention generally comprises a base with a planar bottom face and a side wall. As shown in FIG. 1, the side wall is defined by a pair of generally triangular planar side faces defining a 90 degree angle. Further, such side wall is defined by a tapering arcuate side face formed between the planar side faces. Mounted on a top of the base is a male couple that extends upwardly therefrom the details of which will be set forth hereinafter. Next provided is a plurality of posts, as shown in FIG. 2. Such posts each include a top end with a male couple mounted thereon and extending upwardly therefrom. Associated therewith is a bottom end with a female couple formed therein. A plurality of sections are formed between the top end and the bottom end in coaxial alignment. Each section includes a cylindrical lower extent and a diverging upper extent. Similar to the base, the upper extent of each section is defined by defined by a pair of generally triangular planar side faces defining a 90 degree angle and a tapering arcuate side face formed between the planar side faces of the section. With reference now to FIG. 3, the upper extent of each section is shown to have a planar top face with a plurality of recesses formed therein. The posts are interconnected via the couples and further connected to the base. Next provided is a plurality of brackets each having a rear face with a planar rectangular configuration. FIG. 4 shows each bracket to have a pair of side faces mounted to side edges of the rear face and extending outwardly and forwardly therefrom. Such side faces of the mount thus define a right angle with respect to each other. A horizontal member is integrally coupled to a central extent of a front surface of the rear face and between the side faces of the bracket. The horizontal member has a female couple formed therein the details of which will be set forth hereinafter. A rear surface of the rear face and the side faces of each bracket are lined with an elastomeric material. In use, the female couples of the brackets are adapted for receiving the male couples of the posts and base for abutting a wall. FIG. 1 shows a plurality of branches each having a generally linear outboard portion with a plurality of bristles mounted thereon. The branches each further have an inverted J-shaped inboard portion with a tapered point for being removably mounted within one of the recesses of the posts. It should be noted that the aforementioned couples each have a cross-section with a circular central portion and a pair of diametrically disposed elliptical protrusions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new space saving split tree apparatus and method which has many of the advantages of the artificial Christmas trees mentioned heretofore and many novel features that result in a new space saving split tree which is not anticipated, rendered obvious, suggested, or even implied by any of the prior art artificial Christmas trees, either alone or in any combination thereof.

It is another object of the present invention to provide a new space saving split tree which may be easily and efficiently manufactured and marketed.

It is a further object of the present invention to provide a new space saving split tree which is of a durable and reliable construction.

An even further object of the present invention is to provide a new space saving split tree which is susceptible of a low cost of manufacture with regard to both materials and labor, and which accordingly is then susceptible of low prices of sale to the consuming public, thereby making such space saving split tree economically available to the buying public.

Still yet another object of the present invention is to provide a new space saving split tree which provides in the apparatuses and methods of the prior art some of the advantages thereof, while simultaneously overcoming some of the disadvantages normally associated therewith.

Still another object of the present invention is to provide a new space saving split tree for saving space against a wall or in a corner.

Even still another object of the present invention is to provide a new space saving split tree that includes a base and a plurality of posts interconnected with respect to each other and further connected to the base and extending upwardly therefrom. Next provided is a plurality of branches removably coupled to the posts, wherein the branches are constrained by an arc of no more than 180 degrees.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
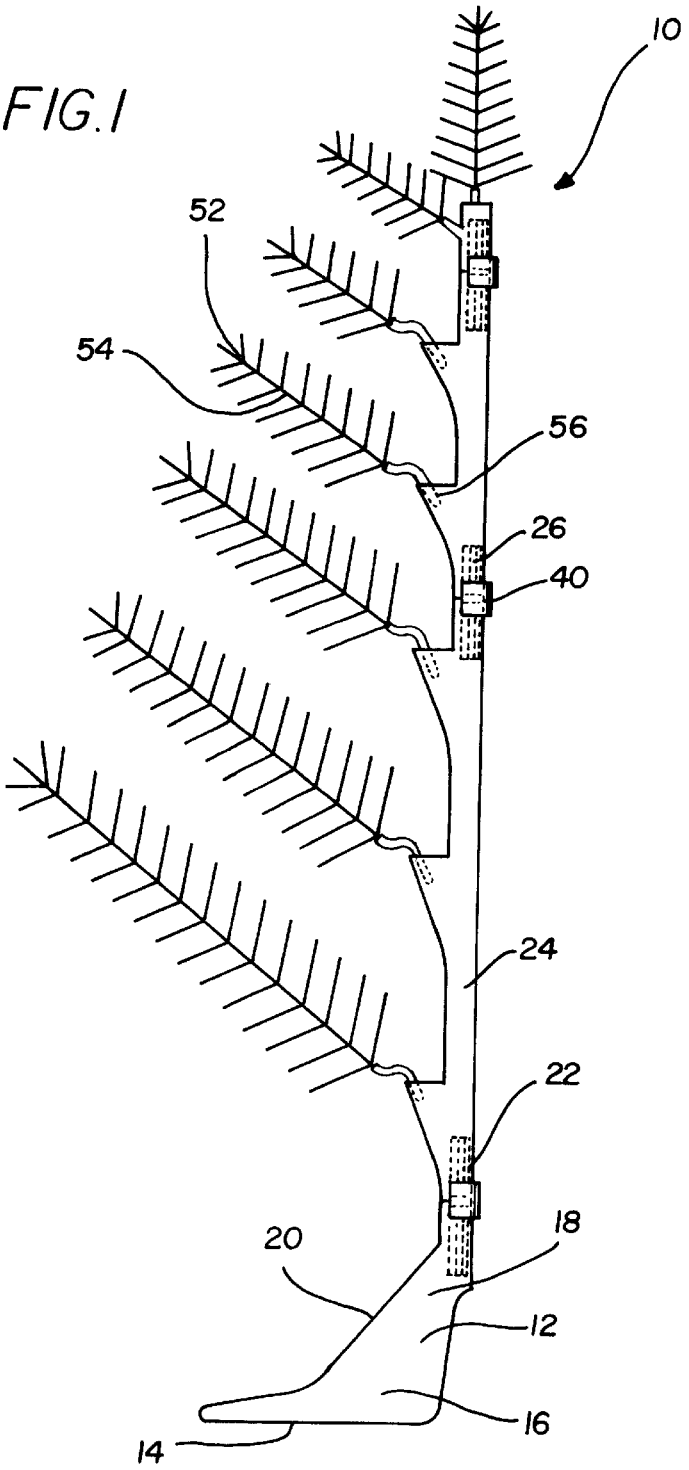
FIG. 1 is a side view of a new space saving split tree according to the present invention.

With reference now to the drawings, and in particular to FIGS. 1 through 5 thereof, a new space saving split tree embodying the principles and concepts of the present invention and generally designated by the reference numeral 10 will be described.

The present invention, designated as numeral 10, includes a base 12 with a planar bottom face 14 having an elastomeric lining and a side wall 16. As shown in FIG. 1, the side wall is defined by a pair of generally triangular planar side faces 18 defining a 90 degree angle. Further, such side wall is defined by a tapering arcuate side face 20 formed between the planar side faces. An edge where the planar side faces meet preferably extends inwardly toward the arcuate side face from top to bottom. See FIG. 1. Mounted on a top of the base is a male couple 22 the details of which will be set forth hereinafter. Ideally, the base is constructed from a fireproof material such as aluminum or the like.

Figure 2:
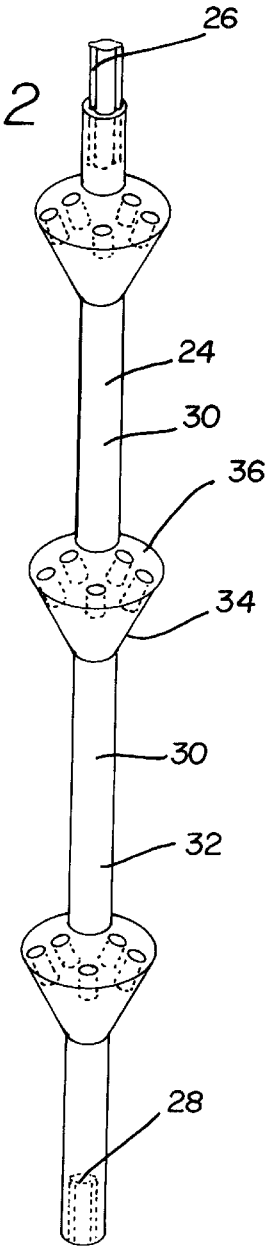
FIG. 2 is a side view of one of the posts of the present invention.

Next provided is a plurality of posts 24, as shown in FIG. 2. Such posts each include a top end with a male couple 26 mounted thereon and extending upwardly therefrom. Associated therewith is a bottom end with a female couple 28 formed therein. A plurality of sections 30 are formed between the top end and the bottom end in coaxial alignment. It should be noted that the number of sections on each post may vary per the desires of the user. An uppermost one of the posts preferably has a free upper end with branches extending therefrom, as shown in FIG. 1. Each section includes a cylindrical lower extent 32 and a diverging upper extent 34. Similar to the base, the upper extent of each section is defined by defined by a pair of generally triangular planar side faces defining a 90 degree angle and a tapering arcuate side face formed between the planar side faces of the section. In operation, the posts are interconnected via the couples and further connected to the base.

Figure 3:
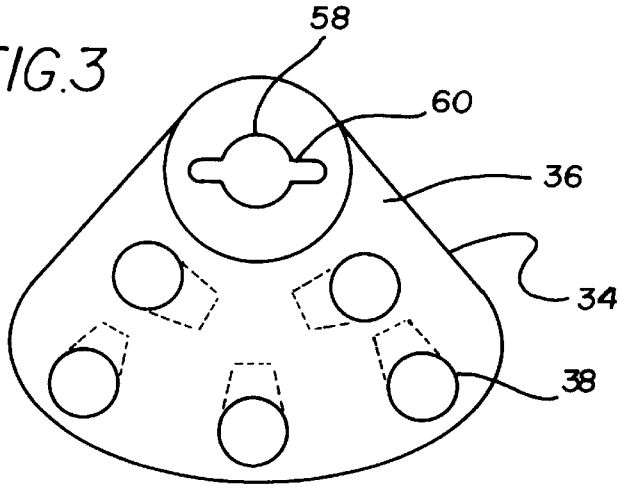
FIG. 3 is a top view of one of the posts of the present invention.

With reference now to FIG. 3, the upper extent of each section is shown to have a generally planar top face 36 with a plurality of recesses 38 formed therein. Such recesses preferably include at least three of a first set of recesses which are positioned about axes constrained by a 90 degree arc. Further, the recesses include at least two of a second set of recess which are positioned about axes constrained by a 180 degree arc. As an option, end recesses of the first set may share an opening with those of the second set. Note FIG. 5.

Figure 4:
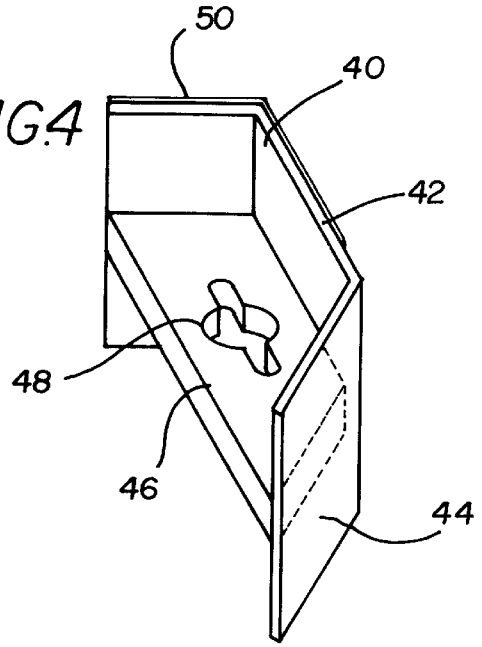
FIG. 4 is a perspective view of one of the brackets of the present invention.
Figure 5:
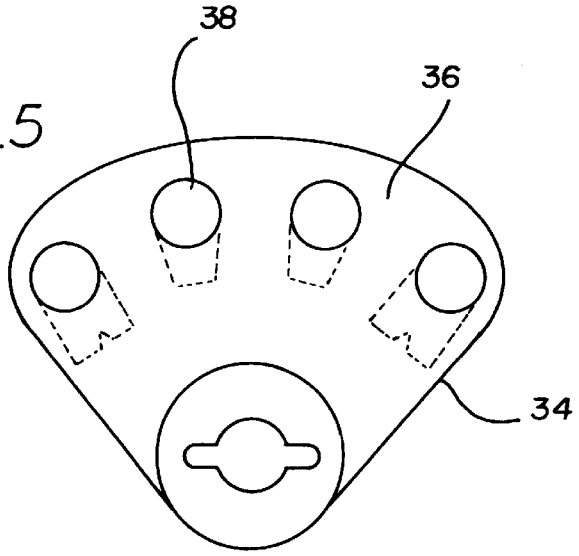
FIG. 5 is an alternate configuration of the recesses of the top faces of the posts.

Next provided is a plurality of brackets 40 each having a rear face 42 with a planar rectangular configuration. FIG. 4 shows each bracket to further have a pair of side faces 44 mounted to side edges of the rear face and extending outwardly and forwardly therefrom. Such side faces of the mount thus define a right angle with respect to each other. A horizontal member 46 is integrally coupled to a central extent of a front surface of the rear face and between the side faces of the bracket. The horizontal member has a female couple 48 formed therein the details of which will be set forth hereinafter. A rear surface of the rear face and the side faces of each bracket are lined with an elastomeric material 50. In use, the female couples of the brackets are adapted for receiving the male couples of the posts and base which in turn are inserted into a female couple of an adjoining post. The brackets serve for abutting an adjacent wall.

FIG. 1 shows a plurality of branches 52 each having a generally linear outboard portion 54 with a plurality of bristles mounted thereon. The branches each further have an inverted J-shaped inboard portion 56 with a tapered point for being removably mounted within one of the recesses of the posts. It should be noted that the branches may be selectively positioned within the first and/or second set of recesses depending on whether the present invention is positioned in a corner or against a wall.

It should be noted that the aforementioned couples each have a cross-section with a circular central portion 58 and a pair of diametrically disposed elliptical protrusions 60. Note FIG. 3 in particular. The central portion of each couple is preferably of a lesser cross-sectional area with respect to the associated base or post. By this structure, the upper extents of the posts are positioned in alignment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A space saving decorative tree comprising, in combination:

a base with a planar bottom face, a side wall defined by a pair of generally triangular planar side faces defining a corner having a 90 degree angle and a tapering arcuate side face formed between the planar side faces, and a male couple mounted on a top of the base and extending upwardly therefrom, the male couple being positioned towards the corner of the side faces and having a vertical axis extending therethrough, said vertical axis of said male couple extending outside an outer periphery of said bottom face;

a plurality of posts each including a top end with a male couple mounted thereon and extending upwardly therefrom, a bottom end with a female couple formed therein, and a plurality of sections formed between the top end and the bottom end in coaxial alignment, each section including a cylindrical lower extent and a diverging upper extent defined by a pair of generally triangular planar side faces defining a 90 degree angle and a tapering arcuate side face formed between the planar side faces of the section, the upper extent of each section having a planar top face with a plurality of recesses formed therein, wherein the posts are interconnected via the couples and further connected to the base;

wherein the recesses include at least three of a first set of recesses being positioned about axes constrained by a 90 degree arc;

wherein the recesses further include at least two of a second set of recess which are positioned about axes constrained by a 180 degree arc;

a plurality of brackets adapted for resting against a wall, each of the brackets having a rear face with a planar rectangular configuration, a pair of side faces mounted to side edges of the rear face and extending outwardly and forwardly therefrom for defining a right angle with respect to each other, a horizontal member integrally coupled to a central extent of a front surface of the rear face and between the side faces of the bracket, the horizontal member having a female couple formed therein, a rear surface of the rear face and the side faces each being lined with an elastomeric material, wherein the female couples of the brackets are adapted for receiving the male couples of the posts and base for abutting a wall; and a plurality of branches each having a generally linear outboard portion with a plurality of bristles mounted thereon and extending radially therefrom, the branches each having an inverted J-shaped inboard portion with a tapered point for being removably mounted within one of the recesses of the posts;

said couples each having a cross-section with a circular central portion and a pair of diametrically disposed elliptical protrusions.

2. A space saving decorative tree comprising:

a base having a bottom face a side wall defined by a pair of generally triangular planar side faces defining a corner having about a 90 degree angle and a male couple mounted on a top of the base and extending upwardly therefrom the male couple being positioned towards the corner of the side faces;

a plurality of posts interconnected with respect to each other to form a trunk of the tree, the trunk being connected to the base and extending upwardly therefrom; and a plurality of branches removably coupled to the posts of the trunk, each of the branches having a mounting end removably attached to one of the posts, each of the branches having a longitudinal extent extending away from the mounting end wherein the branches are constrained by an arc of no more than 180 degrees.

3. A space saving decorative tree as set forth in claim 2 wherein a padding material is positioned on the tree for abutting an adjacent wall.

4. A space saving decorative tree as set forth in claim 3 wherein a plurality of brackets are mounted on the posts each with the padding material positioned thereon.

5. A space saving decorative tree as set forth in claim 4 wherein the brackets are mounted between the posts.

6. A space saving decorative tree as set forth in claim 2 wherein the posts are coupled via male couples and female couples each having a cross-section with at least a pair of protruding side extents.

7. A space saving decorative tree as set forth in claim 2 wherein the posts each have diverging portions which define an upper face with a plurality of apertures formed therein for receiving the branches.

8. A space saving decorative tree as set forth in claim 7 wherein the apertures include at least three of a first set of recesses being positioned about axes constrained by a 90 degree arc.

9. A space saving decorative tree as set forth in claim 8 wherein the apertures further include at least two of a second set of recess which are positioned about axes constrained by a 180 degree arc.

* * * * *